US005853970A

United States Patent [19]

Poncelet et al.

[11] Patent Number: 5,853,970

[45] **Date of Patent: *Dec. 29, 1998**

[54] METHOD FOR IMPROVING THE CONSERVATION OF A PHOTOGRAPHIC PRODUCT WITH A CELLULOSE ESTER TYPE SUPPORT

[75] Inventors: Olivier J. Poncelet; Jeannine Rigola, both of Chalon sur Saone; Boualem Mekki, Lyons, all of France

[73] Assignee: Eastman Kodak Company, Rochester, N.Y.

[ * ] Notice: The term of this patent shall not extend beyond the expiration date of Pat. No. 5,714,309.

[21] Appl. No.: 842,753

[22] Filed: Apr. 16, 1997

[30] Foreign Application Priority Data

Apr. 29, 1996 [FR] France ..... 96 05591

[51] Int. Cl.[6] ..... G03C 1/775; G03C 1/93

[52] U.S. Cl. ..... 430/536; 430/432; 430/531; 430/539; 430/961; 430/538

[58] Field of Search ..... 430/530, 527, 430/531, 539, 961, 538, 536

[56] References Cited

U.S. PATENT DOCUMENTS

| | | | |
|---|---|---|---|
| 4,022,622 | 5/1977 | Timmerman et al. | 430/961 |
| 5,215,192 | 6/1993 | Ram et al. | 206/205 |
| 5,508,135 | 4/1996 | Lelental et al. | 430/530 |
| 5,714,309 | 2/1998 | Poncelet et al. | 430/531 |

FOREIGN PATENT DOCUMENTS

| | | |
|---|---|---|
| A 0 618 489 | 10/1994 | European Pat. Off. . |
| A-2109752 | 4/1972 | Germany . |
| WO A-96/13459 | 5/1996 | WIPO . |

*Primary Examiner*—Richard L. Schilling
*Attorney, Agent, or Firm*—Carl F. Ruoff

[57] ABSTRACT

The present invention improves the conservation of a photographic product with a cellulose ester type support. The present invention involves coating on the support or the photographic product with a transparent film-forming aqueous composition. The composition is a fibrous aluminosilicate polymer of formula $Al_xSi_yO_z$ in which x:y is between 1 and 3, and z is between 2 and 6. The support can be treated before the application of the photographic layers (as a substratum or under-layer) or after the application of the photographic layers (as a top layer). It is also possible to treat an exposed, developed film by applying a top layer of the said composition.

3 Claims, No Drawings

METHOD FOR IMPROVING THE CONSERVATION OF A PHOTOGRAPHIC PRODUCT WITH A CELLULOSE ESTER TYPE SUPPORT

FIELD OF THE INVENTION

The present invention concerns a method for improving the conservation of a photographic product with a cellulose ester type support.

BACKGROUND OF THE INVENTION

The preservation of cinematographic films with a support of the cellulose ester type is an important criterion for producers, directors and institutions keen to safeguard their heritage. Different types of cellulose ester have been used, such as cellulose acetate butyrate, cellulose acetate propionate and cellulose triacetate. These types of support offer a certain advantage over cellulose nitrate, which was abandoned in the 1950s owing to its instability and the danger that it represented. However, archiving film of the cellulose ester type, exposed and developed, is made very difficult by the decomposition of the support, which is accompanied by a release of acetic acid, and hence the name "vinegar syndrome" given to this phenomenon described in the literature, see for example Adelstein, PZ et al, SMPTE Journal 1995, May, 281, or Ram, T et al, J. Imag. Sci. 1994, 38(3), 249.

Certain chemical compounds required in the processing of film, along with atmospheric contaminants (hydrogen peroxide, sulphur dioxide, ozone, nitrogen oxide, etc) also contribute to the deterioration of the images contained on film with a triacetate support.

U.S. Pat. No. 5,215,192 describes a method which improves the archiving of a photographic product which has been exposed and developed. This patent describes the use of zeolite-based molecular sieves having the ability to absorb moisture, acetic acid and residual solvents. These molecular sieves are packaged in sachets placed inside archive canisters.

However, since most of the gaseous releases take place in the area where the film is winding between the reels (see U.S. Pat. No. 5,215,192 column 4, lines 36–41), the aforementioned technique does not inhibit deterioration sufficiently. This is why the present invention recommends a treatment applied directly to the film to be archived, which enables the level of acetic acid, moisture and residual solvents to be controlled, while leaving a transparent protective layer which preserves the quality of the image.

The applicant recently described a fibrous inorganic polymer of aluminium and silicon and a method for synthesising it in the international patent application PCT/EP 95/04165, filed on 24 Oct. 1995, entitled "Alumino-silicate polymer and method for preparing it".

The present invention has as its object the use of a composition of the aforementioned fibrous inorganic polymer to improve the conservation of a photographic product with a cellulose ester type support.

SUMMARY OF THE INVENTION

The composition used according to the invention is a film-forming aqueous composition which comprises a fibrous alumino-silicate polymer of formula $Al_xSi_yO_z$ in which x:y is between 1 and 3, and z is between 2 and 6.

According to one embodiment, the composition also comprises a water-soluble polymer binder.

According to the present invention, the polymer binder, when there is one, is water-soluble, that is to say it can be mixed with water in proportions enabling a person skilled in the art to obtain a composition which is homogeneous and optically clear to the naked eye, in a temperature range between room temperature and 75°. The binder must enable a transparent composition to be produced which is applicable in a layer using the usual techniques (see Research Disclosure, publication 17643, December 1978, chapter XVA, page 27). A person skilled in the art will be able to adjust the concentrations of the components so as to obtain a composition whose viscosity falls within a range of between 4 and 20 centipoise.

Useful polymer binders comprise proteinaceous binders, for example deionised gelatine, gelatine derivatives, hydrophilic cellulosic substances such as methylcellulose, polyalkylene glycols such as polyethylene glycols, with a molecular mass between 103 and 106, polyvinyl alcohol, polyethylene oxides and polyacrylamides.

DESCRIPTION OF THE PREFERRED EMBODIMENTS

In the composition according to the invention, the alumino-silicate is a fibrous substance, described in the aforementioned international patent application PCT/EP 95/04165. According to this patent application, the alumino-silicate is obtained by means of a method comprising the following main steps:

(a) a mixed alcoxide of aluminium and silicon or a precursor of such an alcoxide is mixed with an aqueous alkali, at a pH between 4 and 6.5 and advantageously between 4.6 and 5.6, keeping the aluminium concentration between 5×10–4M and 10–2M, (b) the mixture obtained in (a) is heated at a temperature below 100° C. in the presence of a silanol group, for example in the form of divided silica, for a sufficient period to obtain a complete reaction resulting in the formation of a polymer, and (c) the ions are eliminated from the reactional mixture obtained in (b). The reaction in step (b) is considered to be complete when the reactional medium no longer contains any cations other then those of the alkali, that is to say when the Al and Si ions have been consumed.

According to one embodiment, the initial product, at step (a), is a precursor which is the product of the hydrolysis reaction of an aluminium salt, for example aluminium chloride, and a silicon alcoxide.

The composition according to the invention has a viscosity which is such that it can be layered easily. This viscosity will be between 4 and 20 centipoise. The composition according to the invention can contain different additives normally used in compositions of this type and designed to improve the characteristics which assist layering, or the stability of layers, for example thickeners, wetting agents, surfactants or preservatives. The alumino-silicate content of the composition will be adjusted by persons skilled in the art so as to obtain a layer after drying which has an Al+Si content between 50 and 100 mg/m2 (per treated face), and ideally between 70 and 90 mg/m2 (per treated face).

The alumino-silicate polymer can be used in several ways. The cellulose ester support can be treated before the application of the photographic layers (as a substratum or under-layer), or after the application of the photographic layers (as a top layer), by means of a film-forming aqueous composition as described according to the invention. It is also possible to treat an exposed, developed film by passing it through a bath with such a composition or spraying such a composition onto its surface.

In particular, the film to be treated can be either immersed in an extra bath, at the end of the photographic processing line, with a temperature between room temperature and 40° C., or coated onto both faces by means of a top layer based on the said composition using normal techniques (see Research Disclosure, publication 17643, December 1978, chapter XV-A, page 27). The layer obtained, after drying, has a thickness of at least 1 $\mu$m. In general terms, the binder used is not initially cross-linked, so that an optimum mixture with the alumino-silicate polymer is promoted, but the layer can, nonetheless, be tanned during a subsequent step, by means of the tanning agents normally used in the preparation of photographic products (see Research Disclosure, publication 36544, September 1994, chapter II-B, page 508).

Where the binder is gelatine or a gelatine derivative, it is necessary to adjust the pH of the alumino-silicate polymer solution to a value below the isoelectric point of gelatine to avoid precipitation.

The inside of the storage canisters for the reels can also be treated by coating with a top layer of the said composition. The reels can be stored in canisters made of plastic (polyethylene, polypropylene, polycarbonate, etc) or metal.

In order to evaluate the efficacy of the method according to the invention, a method of accelerated ageing is used which is described in the literature, see for example Adelstein, PZ et al, SMPTE Journal 1995, May, 281, or Ram, T et al, J. Imag. Sci. 1994, 38(3), 249.

The following examples illustrate the invention.

EXAMPLE 1

An alumino-silicate polymer is prepared according to the method in Example 2 of the aforementioned patent application PCT/EP 95/04165. This alumino-silicate comprises 3.88 g of Al+Si/l, with an Al:Si molar ratio of 2. For a mixture of 1031 g of this alumino-silicate (4.0 g Al+Si), 0.18% by weight of Tween 80™ non-ionic surfactant is added with respect to the Al+Si weight. While stirring, the above composition is mixed with 400 g of an aqueous solution of Type IV photographic gelatine containing 1% by weight of dry gelatine while keeping the temperature at 40° C. The volume is adjusted to 1600 ml using water to obtain an Al+Si content of 2.5 g/l. The stirring of the mixture is continued for 1 hour 30 minutes while keeping the temperature at 40° C. This composition is applied to both faces of a film with an exposed and developed cellulose triacetate support.

The covering on this film after drying is around 80 mg/m2 per face. The control film (film B), which is identical except that it does not include a layer of the composition and which comes from the same sample as film A, is placed in a second airtight metal canister identical to the preceding one. The two canisters are placed in the same oven at 80° C. for 21 days. The relative humidity level within the canisters is around 50%. This test simulates an accelerated ageing of the film.

EXAMPLE 2

An alumino-silicate polymer is prepared according to the method in Example 2 of the aforementioned international patent application PCT/EP 95/04165. This alumino-silicate comprises 2.5 g Al+Si/l, with an Al:Si molar ratio of 2. This composition is applied directly to both faces of a film with an exposed and developed cellulose triacetate support. The covering of Al+Si on the top layer is around 80 mg/m2 per face after drying. The treated film (film C) is placed in an airtight metal canister. A control film (Film D) which is identical except that it does not have a top layer of the composition and which comes from the same sample as film C, is placed in a second airtight canister identical to the preceding one. The two canisters are placed in the same oven at 80° C. for 21 days. The relative humidity level within the canisters is around 50%. This test simulates an accelerated aging of the film.

Results

Following the treatments in Examples 1 and 2, the quality of the films A, B, C and D is assessed visually according to the following criteria:

A=the support shows no sign of deterioration and the quality of the image is excellent;

B=the support shows no sign of deterioration and the quality of the image is acceptable;

C=the support has deteriorated and the quality of the image is unacceptable;

The results obtained are shown in the following table:

| Quality of support and image | | |
|---|---|---|
| Example 1 | Film A | B |
| | Film B | C |
| Example 2 | Film C | B |
| | Film D | C |

These results show that exposed, developed photographic films with a support of the cellulose ester type, which have undergone a treatment according to the invention, exhibit, after an accelerated ageing test, a quality of support and image which are much higher than the same films when untreated.

In order to assess the ability of the protective top layer to adsorb acetic acid, a sample of blank cellulose triacetate is treated with a composition, according to the method in Example 2, having an alumino-silicate content expressed in terms of Al+Si of 5.87 g/l. The covering with Al+Si of the layer obtained after drying is around 200 mg/m2 per face. This treated support is placed in an airtight metal canister. A control sample of blank cellulose triacetate, untreated and identical to the previous one, is placed in a sealed canister identical to the previous one.

These two canisters are placed in the same oven at 80° C. for 21 days. The relative humidity level within the canisters is around 50%. After heating, the treated support has an acceptable physical appearance while the untreated support has deteriorated. By scraping the treated support with a razor blade, a sample of the layer of alumino-silicate is obtained in the form of powder. A sample of the untreated support is prepared in powder form. These two samples are analysed by mass spectroscopy (Nermag R-10-100 model) under the following operating conditions:

vacuum=10−5 torr starting temperature=30° C.

heating: 20°/min maximum temperature=300° C.

introduction of the sample=direct mode.

The sample from the treated support clearly shows the presence of acetic acid, while the sample from the untreated support does not exhibit this characteristic. The layer of alumino-silicate polymer adsorbs the acetic acid and acts as a barrier against the release of acetic acid, which stabilise the cellulose ester type support.

The invention has been described in detail with particular reference to certain preferred embodiments thereof, but it will be understood that variations and modifications can be effected within the spirit and scope of the invention.

We claim:

1. A photographic element comprising a cellulose ester support;

at least one silver halide light-sensitive layer superposed on said support;

a transparent top layer superposed on said light-sensitive layer comprising a fibrous alumino-silicate polymer of the formula $Al_xSi_yO_z$ wherein x is between 1 and 3, y is between 1 and 3 and z is between 2 and 6 and a water-soluble binder selected from the group consisting of proteinaceous hydrophilic polymers, cellulose derivatives, polyalkylene glycols and polyvinyl alcohols.

2. The photographic element of claim 1, wherein the alumino-silicate polymer was obtained by the following method:

a) a mixed alcoxide of aluminium and silicon or a precursor of such an alcoxide is mixed with an aqueous alkali or a precursor of such an alcoxide, with an aqueous alkali, at a pH between 4 and 6.5, keeping the concentration between 5×10–4 and 10–2M;

b) the mixture obtained in (a) is heated at a temperature below 100° C., for a sufficient period to obtain a complete reaction resulting in the formation of a polymer, and c) the salts are eliminated from the reactional mixture obtained in (b).

3. The photographic element of claim 1, wherein said cellulose ester support comprises cellulose triacetate, cellulose acetate butyrate or cellulose acetate propionate.

* * * * *